US010989218B2

(12) United States Patent
Xu et al.

(10) Patent No.: US 10,989,218 B2
(45) Date of Patent: Apr. 27, 2021

(54) FAN WHEEL STRUCTURE

(71) Applicant: ASIA VITAL COMPONENTS CO., LTD., New Taipei (TW)

(72) Inventors: Liang-Hua Xu, New Taipei (TW); Te-Chung Wang, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 87 days.

(21) Appl. No.: 15/990,833

(22) Filed: May 29, 2018

(65) Prior Publication Data

US 2019/0368504 A1 Dec. 5, 2019

(51) Int. Cl.

| | |
|---|---|
| ***F04D 29/28*** | (2006.01) |
| ***F04D 29/30*** | (2006.01) |
| ***F04D 29/24*** | (2006.01) |
| ***F01D 5/14*** | (2006.01) |
| *F04D 25/06* | (2006.01) |
| *F01D 5/22* | (2006.01) |

(52) U.S. Cl.

CPC ..... *F04D 29/282* (2013.01); *F01D 5/141* (2013.01); *F04D 29/242* (2013.01); *F04D 29/28* (2013.01); *F04D 29/30* (2013.01); *F01D 5/22* (2013.01); *F04D 25/0613* (2013.01)

(58) Field of Classification Search

CPC .... F04D 29/2216; F04D 29/242; F04D 29/30; F04D 29/28; F04D 29/281; F04D 29/284; F01D 5/141; F01D 5/22

USPC ..... 361/695, 678

See application file for complete search history.

(56) References Cited

U.S. PATENT DOCUMENTS 6,877,954 B2 * 4/2005 Lin ..... F04D 29/281 257/E23.099

7,083,387 B2 * 8/2006 Chen ..... F04D 29/325 416/189

(Continued)

FOREIGN PATENT DOCUMENTS

CN 101338766 A 1/2009

CN 104251229 A 12/2014

(Continued)

OTHER PUBLICATIONS

Chinese Patent Office first office action of CN108612671A (Year: 2019).*

*Primary Examiner* — David E Sosnowski

*Assistant Examiner* — Wesley Le Fisher

(74) *Attorney, Agent, or Firm* — Bradley J. Thorson; DeWitt LLP

(57) ABSTRACT

A fan wheel structure includes a hub provided with a plate member and a plurality of blades. The plate member is located around the hub and has an upper side and a lower side. The blades are arranged on the upper side of the plate member and respectively have a connecting end connected to the hub as well as a free end. The blades respectively include a backward-curved section, a middle section and a forward-curved section. The backward-curved section is located adjacent to the connecting end and connected to the upper side of the plate member; the forward-curved section is located adjacent to the free end; and the middle section is connected at two opposite ends to the backward-curved section and the forward-curved section. And, an air passage is formed on the upper side of the plate member between any two adjacent backward-curved sections.

5 Claims, 3 Drawing Sheets

(56) References Cited

U.S. PATENT DOCUMENTS

| | | | | |
|---|---|---|---|---|
| 7,207,779 | B2 * | 4/2007 | Horng | F04D 29/283 416/186 R |
| 7,988,538 | B2 * | 8/2011 | Trautner | H02K 5/148 451/344 |
| 8,007,232 | B2 * | 8/2011 | Hwang | F04D 29/281 415/182.1 |
| 8,113,782 | B2 * | 2/2012 | Horng | F04D 29/624 416/178 |
| 8,254,112 | B2 * | 8/2012 | Yang | H01L 23/427 165/185 |
| 2004/0202535 | A1 | 10/2004 | Lin et al. | |
| 2012/0275932 | A1 * | 11/2012 | Sharma | A01M 1/2044 417/66 |
| 2014/0127029 | A1 * | 5/2014 | Yang | F04D 29/281 416/223 B |
| 2015/0152883 | A1 * | 6/2015 | Dybenko | F04D 25/0613 415/220 |
| 2016/0312796 | A1 * | 10/2016 | Birschbach | F04D 29/281 |
| 2019/0128278 | A1 * | 5/2019 | Chan | F04D 29/281 |

FOREIGN PATENT DOCUMENTS

| | | | |
|---|---|---|---|
| CN | 205172994 | U | 4/2016 |
| CN | 205298053 | U | 6/2016 |
| CN | 206092502 | U | 4/2017 |
| TW | M250230 | | 11/2004 |

* cited by examiner

FAN WHEEL STRUCTURE

FIELD OF THE INVENTION

The present invention relates to a fan wheel structure, and more particularly, to a fan wheel structure capable of reducing the vibration and noise produced by a fan in operation.

BACKGROUND OF THE INVENTION

In the field of heat dissipation, when a centrifugal fan operates, air flow axially enters the fan and then sidewardly exits the fan to achieve the purpose of dissipating heat. Conventional centrifugal fans can be classified into backward-inclined/curved and forward-inclined/curved blade fans according to the angle included between the blade and a tangent in the direction of exit. The forward-inclined/curved blades incline or curve in the direction of the fan wheel's rotation, and the angle included between the forward-inclined/curved blade and the tangent in the direction of exit is larger than 90°. The forward-inclined/curved blades are shorter in the radial direction; and they produce more air volume and faster air velocity but also relatively high noise during rotation. On the other hand, the backward-inclined/curved blades incline or curve against the direction of the fan wheel's rotation, and the angle included between the backward-inclined/curved blade and the tangent in the direction of exit is smaller than 90°. The backward-inclined/curved blades are longer in the radial direction; and they produce air flow of lower velocity but higher pressure.

Under the conditions of the same fan rotational speed and the same fan blade outer diameter, the forward-inclined/curved blades can output a relatively high air volume to provide a better heat dissipation effect, which, however, results in an increased load of motor; on the other hand, the backward-inclined/curved blades can only output a relatively low air volume to provide a lower heat dissipation effect than the forward-inclined/curved blades. In other words, the backward-inclined/curved blades can produce the same air volume and the same heat dissipation effect as the forward-inclined/curved blades only when the fan rotational speed is increased. However, the backward-inclined/curved blades rotating at an increased speed will also produce higher noise.

Further, when the conventional centrifugal fan operates and air axially enters the fan, a part of the air is brought by the fan blades to sidewardly exit the fan, while another part of the air flows through between the blades to hit a base or a frame of the fan and flows backward to areas around the hub and the blades of the fan. This condition results in reduced sidewardly output air volume, and the backward air flow will form turbulence to adversely produce noise and vibration when the fan operates.

It is therefore tried by the inventor to develop an improved fan wheel structure that helps a fan to produce increased air volume and air pressure at the same time while reduces the vibration and shake produced by rotating fan blades, as well as prevents air streams from flowing through between blades to hit a fan base or a fan frame to form turbulence that will cause vibration and noise.

SUMMARY OF THE INVENTION

A primary object of the present invention is to provide a fan wheel structure that is able to increase the output air volume and air pressure produced while reduce the vibration and noise produced by fan blades when the fan operates.

Another object of the present invention is to provide a fan wheel structure that prevents air streams from flowing through between blades to hit a fan base or a fan frame, so that no air stream will flow backward from the fan base or frame to form turbulence and cause vibration and noise.

To achieve the above and other objects, the fan wheel structure according to a preferred embodiment of the present invention includes a hub provided with a plate member and a plurality of blades. The plate member is located around a circumferential edge of the hub and has an upper side and a lower side. The blades are arranged on the upper side of the plate member and respectively have a connecting end connected to the circumferential edge of the hub as well as a free end opposite to the connecting end. The blades respectively include a backward-curved section, a middle section and a forward-curved section. The backward-curved section is located adjacent to the connecting end and connected to the upper side of the plate member; the forward-curved section is located adjacent to the free end; and the middle section is connected at two opposite ends to the backward-curved section and the forward-curved section. And, an air passage is formed on the upper side of the plate member between any two adjacent backward-curved sections.

With the present invention, the blades of the fan wheel structure in rotating can simultaneously produce increased air volume and air pressure while reducing the vibration and shake. Meanwhile, the fan wheel structure of the present invention can prevent air streams from flowing through between the blades to hit the fan base or the fan frame and form turbulence to thereby avoid vibration and noise due to the turbulence.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
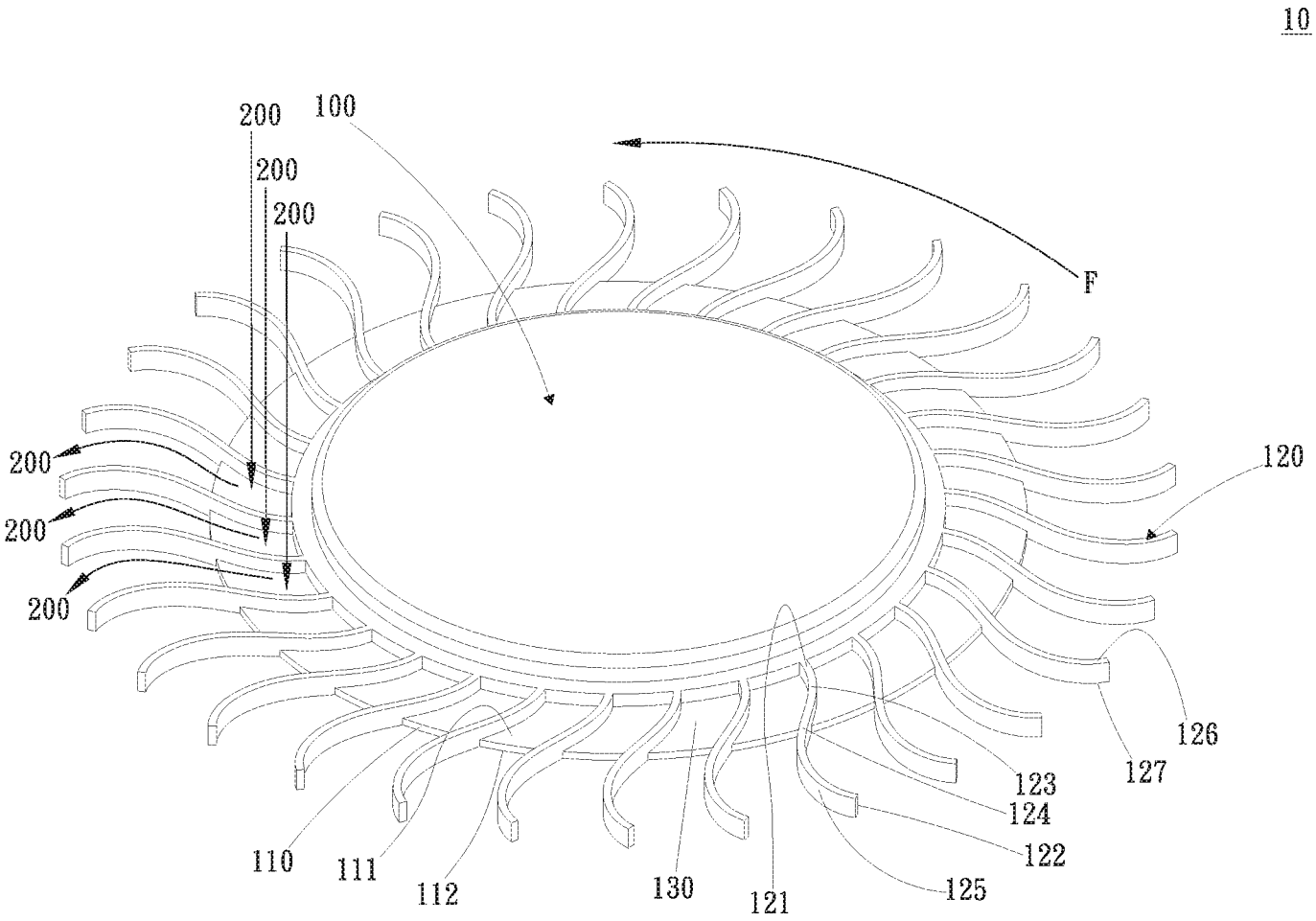
FIG. 1 is a perspective view of a fan wheel structure according to a first embodiment of the present invention.

The present invention will now be described with some preferred embodiments thereof and by referring to the accompanying drawings. For the purpose of easy to understand, elements that are the same in the preferred embodiments are denoted by the same reference numerals.

Please refer to FIG. 1, which is a perspective view of a fan wheel structure 10 according to a first embodiment of the present invention. As shown, in the first embodiment, the fan wheel structure 10 includes a hub 100. Arrow F indicates the rotation direction of the hub 100.

The hub 100 is provided with a plate member 110 and a plurality of blades 120. The plate member 110 is located around a circumferential edge of the hub 100 and has an upper side 111 and a lower side 112 located at two opposite sides of the plate member 110. The blades 120 are arranged on the upper side 111 in an annularly spaced and radially outward extended manner. Each of the blades 120 has a connecting end 121 and a free end 122 located at a radially inner and a radial outer end thereof, respectively.

The connecting end 121 is connected to the circumferential edge of the hub 100. Each of the blades 120 includes a backward-curved section 123, a middle section 124 and a forward-curved section 125. The backward-curved section 123 is located adjacent to the connecting end 121 and connected to the upper side 111 of the plate member 110; the forward-curved section 125 is located adjacent to the free end 122; and the middle section 124 is connected at two opposite ends to the backward-curved section 123 and the forward-curved section 125. An air passage 130 is formed on the upper side 111 of the plate member 110 between any two adjacent backward-curved sections 123.

Further, each of the blades 120 has an upper surface 126 and a lower surface 127. In the first embodiment, the upper and the lower surface 126, 127 are extended from the connecting end 121 to the free end 122. In practical application of the present invention, the hub 100 is mounted on a stator of a fan (not shown). When the stator is supplied with an amount of electric current, it produces an electromagnetic force to drive the hub 100 to rotate. At this point, multiple air streams 200 are axially sucked toward the hub 100.

Each of the air passages 130 functions to guide one air stream 200 to flow radially outward. In FIG. 1, only a part of the air streams 200 is shown. The backward-curved sections 123 of the blades 120 guide the air streams 200 to accelerate while flowing toward the forward-curved sections 125, so as to produce increased air pressure at the forward-curved sections 125. Finally, the air streams 200 flow along the air passages 130 to sidewardly or radially outwardly leave the hub 100.

According to the design of the present invention, the provision of the plate member 110 prevents the air streams 200 from passing through between the backward-curved sections 123 of the blades 120 to hit a base or a frame of the fan. Therefore, no air stream 200 will flow backward from the fan base or the fan frame to form any turbulence, which will undesirably vibrate or shake the blades 120 and accordingly, disadvantageously produce noise when the fan operates. Compared to the conventional centrifugal fans, the backward-curved sections 123 of the blades 120 in the present invention are located adjacent to the connecting ends 121 to produce increased air pressure, while the forward-curved sections 125 are located at a larger distance from the hub 100 to produce increased air volume. Therefore, the fan wheel structure 10 according to the first embodiment of the present invention combines the advantages from both forward-curved blades and backward-curved blades.

Figure 2:
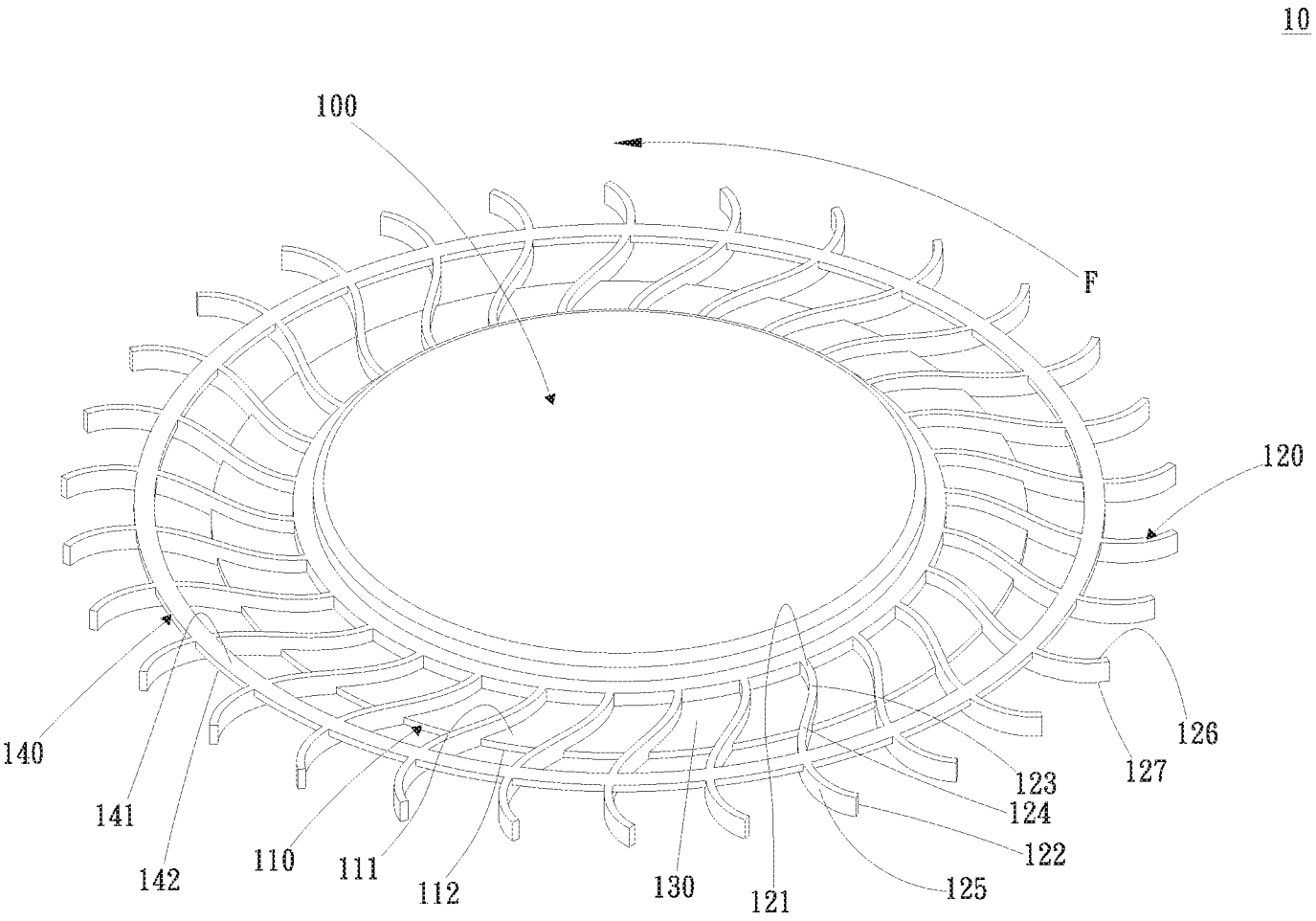
FIG. 2 is a perspective view of a fan wheel structure according to a second embodiment of the present invention.

FIG. 2 is a perspective view of a fan wheel structure according to a second embodiment of the present invention. Please refer to FIG. 2 along with FIG. 1. As shown, since the second embodiment is generally structurally and functionally similar to the first one, elements that are the same in the two embodiments are not repeatedly described herein. The second embodiment is different from the first one in having a hub 100 that further includes a ring member 140. The ring member 140 has a top surface 141 and a bottom surface 142, and is connected to all the blades 120. It is noted the top surface 141 of the ring member 140 is coplanar with the upper surfaces 126 of the blades 120.

In the second embodiment, the ring member 140 is connected to the middle sections 124 of the blades 120. The provision of the ring member 140 can advantageously help the blades 120 to maintain stable without too much vibration during fan operation and can therefore reduce the noise produced when the fan operates.

Figure 3:
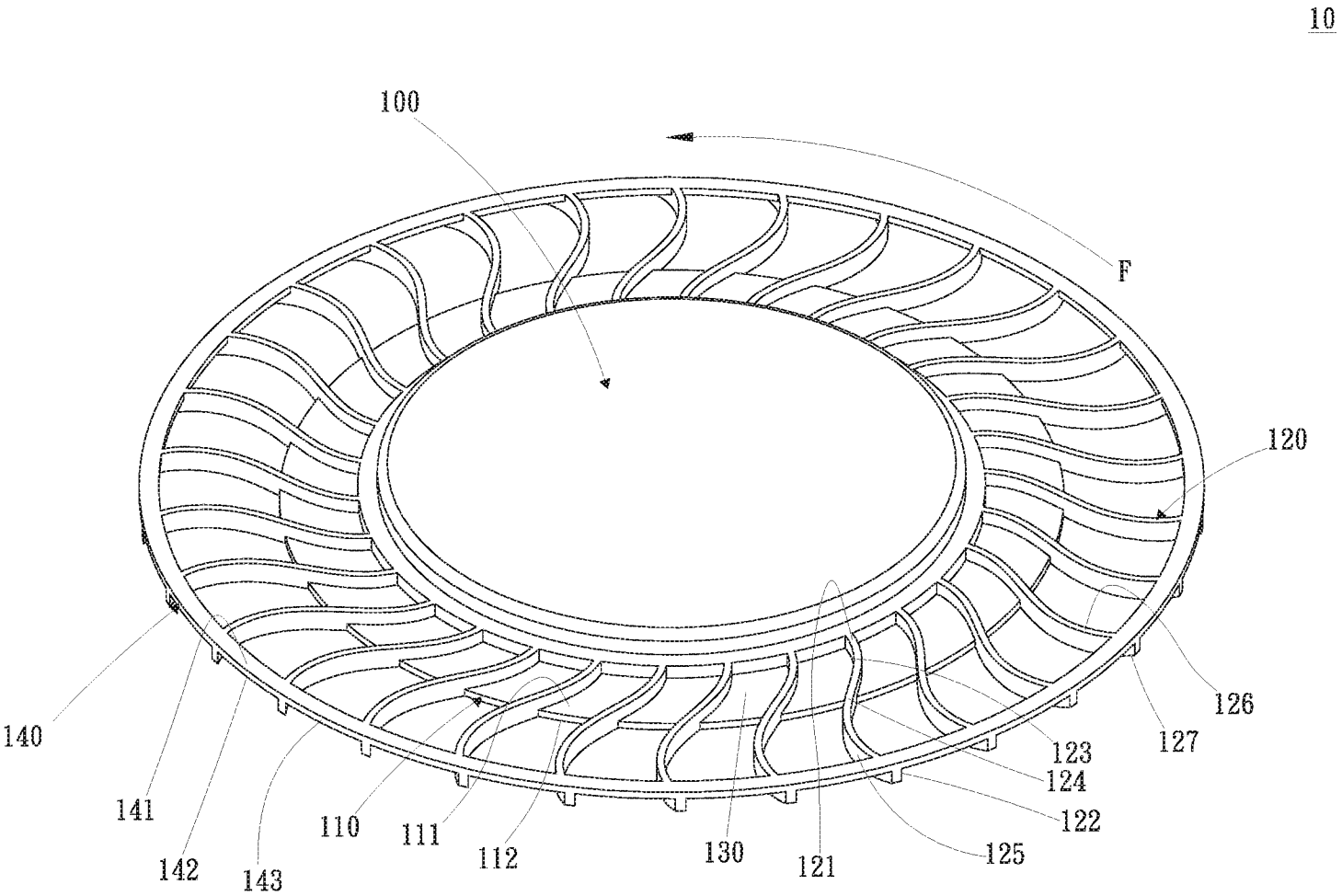
FIG. 3 is a perspective view of a fan wheel structure according to a third embodiment of the present invention.

FIG. 3 is a perspective view of a fan wheel structure according to a third embodiment of the present invention. Please refer to FIG. 3 along with FIG. 2. As shown, since the third embodiment is generally structurally and functionally similar to the second one, elements that are the same in the two embodiments are not repeatedly described herein. The third embodiment is different from the second one in having a ring member 140 that is connected to the forward-curved sections 125 of the blades 120, such that an outer diametrical surface 143 of the ring member 140 and the free ends 122 of the blades 120 are located on the same circumferential surface. With the positional arrangement of the ring member 140 in the third embodiment, it is able to prevent the free ends 122 of the blades 120 from interfering with an inner wall surface of the fan frame and accordingly reduce the noise produced during fan operation.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan wheel structure, comprising a hub provided with a plate member and a plurality of blades;

the plate member being located around a circumferential edge of the hub and having an upper side and a lower side; and the blades being arranged on the upper side of the plate member and respectively having a connecting end connected to the circumferential edge of the hub as well as a free end located opposite to the connecting end; each of the blades including a backward-curved section, a middle section and a forward-curved section; the backward-curved section being located adjacent to the connecting end and connected to the upper side of the plate member; the forward-curved section being located adjacent to the free end; and the middle section being connected at two opposite ends to the backward-curved section and the forward-curved section, the plate member having an outer periphery disposed proximate the middle section of the blades; and an air passage being formed on the upper side of the plate member between any two adjacent backward-curved sections.

2. The fan wheel structure as claimed in claim 1, wherein the blades respectively have an upper surface and a lower surface, which are extended from the connecting end to the free end.

3. The fan wheel structure as claimed in claim 2, wherein the hub further includes a ring member; the ring member having a top surface and a bottom surface, and being connected to all the blades; and the top surface of the ring member being coplanar with the upper surfaces of the blades.

4. The fan wheel structure as claimed in claim 3, wherein the ring member is connected to the middle sections of the blades.

5. The fan wheel structure as claimed in claim 3, wherein the ring member is connected to the forward-curved sections of the blades, and has an outer diametrical surface being coplanar with the free ends of the blades.

* * * * *